US008383215B2

(12) United States Patent
Shi et al.

(10) Patent No.: US 8,383,215 B2
(45) Date of Patent: Feb. 26, 2013

(54) CONTAINER FOR PRODUCTS CONTAINING AROMATIC COMPOUNDS

(75) Inventors: Yu Shi, Branchburg, NJ (US); Joel Millon, Houilles (FR)

(73) Assignee: Colgate-Palmolive Company, New York, NY (US)

( * ) Notice: Subject to any disclaimer, the term of this patent is extended or adjusted under 35 U.S.C. 154(b) by 877 days.

(21) Appl. No.: 12/297,731

(22) PCT Filed: Apr. 19, 2007

(86) PCT No.: PCT/US2007/066949

§ 371 (c)(1),
(2), (4) Date: Aug. 3, 2009

(87) PCT Pub. No.: WO2007/124350

PCT Pub. Date: Nov. 1, 2007

(65) Prior Publication Data

US 2009/0294457 A1 Dec. 3, 2009

Related U.S. Application Data

(60) Provisional application No. 60/793,042, filed on Apr. 19, 2006.

(51) Int. Cl.
*B32B 1/02* (2006.01)
*B32B 1/08* (2006.01)

(52) U.S. Cl. ..... 428/35.2; 428/34.1; 428/35.4; 428/35.5; 428/35.7; 428/36.6; 428/36.9; 428/36.92

(58) Field of Classification Search ..... 428/34.1, 428/34.4, 34.6, 34.7, 35.2, 35.3, 35.4, 35.5, 428/35.7–35.9, 36.4, 35.6, 36.9, 36.91, 36.92, 428/36.6, 36.7

See application file for complete search history.

(56) References Cited

U.S. PATENT DOCUMENTS

| | | | |
|---|---|---|---|
| 3,260,411 | A | 7/1966 | Dobson |
| 3,295,725 | A | 1/1967 | Brandt |
| 3,426,102 | A | 2/1969 | Solak et al. |
| 3,565,293 | A | 2/1971 | Schultz |
| 4,011,968 | A | 3/1977 | McGhie et al. |
| 4,060,179 | A | 11/1977 | McGhie |
| 4,123,576 | A | 10/1978 | Kobayashi et al. |
| 4,132,331 | A | 1/1979 | Magerle |

(Continued)

FOREIGN PATENT DOCUMENTS

| | | | |
|---|---|---|---|
| EP | 0467548 | A | 1/1992 |
| EP | 0469722 | A2 | 3/1995 |

(Continued)

OTHER PUBLICATIONS

BP p.l.c., 2001, "Naphthalates," from website www.bp.com/liveassets/bp_internet/globalbp/STAGING/global_assets/downloads/pdfs/acetyls_aromatics_pta/N_9_General_Polym_Prop.pdf.

(Continued)

*Primary Examiner* — Walter B Aughenbaugh
(74) *Attorney, Agent, or Firm* — Nikhil A. Heble

(57) ABSTRACT

A container is provided for substances that contain an antibacterial compound. The container has a tube body and a tube shoulder. The tube shoulder is made of an alkene based polymer such as a polyethylene or a polypropylene. Such alkene based polymers have a high absorptivity for antibacterial compounds such as triclosan. The shoulder includes a barrier unit. The barrier unit is made of a polymeric material such as polytrimethylene naphthalate, polyethylene naphthalate and acrolonitrile/methacrylate. This barrier unit can be a film on the tube shoulder or a co-injection molded insert in the shoulder. The absorption is less than 10 mg/dm$^2$.

16 Claims, 10 Drawing Sheets

U.S. PATENT DOCUMENTS

| | | | |
|---|---|---|---|
| 4,185,757 | A | 1/1980 | Schultz |
| 4,262,819 | A | 4/1981 | Hayes |
| 4,265,948 | A | 5/1981 | Hayes et al. |
| 4,338,278 | A | 7/1982 | Schultz |
| 4,448,829 | A | 5/1984 | Kohler |
| 4,493,439 | A | 1/1985 | Ledewitz |
| 4,526,297 | A | 7/1985 | Grimsley |
| 4,548,338 | A | 10/1985 | Sander |
| 4,568,001 | A | 2/1986 | Sander |
| 4,664,284 | A | 5/1987 | Magerle |
| 4,693,395 | A | 9/1987 | Tavss et al. |
| 4,792,061 | A | 12/1988 | Nisida |
| 4,834,638 | A | 5/1989 | Miyahara et al. |
| 4,942,981 | A | 7/1990 | Schneider |
| 5,024,354 | A | 6/1991 | Ledewitz |
| 5,035,349 | A | 7/1991 | Donahue |
| 5,203,379 | A | 4/1993 | Holoubek et al. |
| 5,292,034 | A | 3/1994 | Keller |
| 5,372,863 | A | 12/1994 | Nishikawa |
| 5,386,918 | A | 2/1995 | Neveras et al. |
| 5,407,742 | A | 4/1995 | Tavss et al. |
| 5,556,678 | A | 9/1996 | Jupin et al. |
| 5,618,365 | A | 4/1997 | Rebeyrolle et al. |
| 5,656,346 | A | 8/1997 | Hirt |
| 5,913,434 | A | 6/1999 | Fukuhara et al. |
| 5,972,446 | A | 10/1999 | Kaya et al. |
| 6,042,906 | A | 3/2000 | Itoh et al. |
| 6,331,331 | B1 | 12/2001 | Millon et al. |
| 6,547,094 | B1 * | 4/2003 | Jacobs ..... 220/839 |
| 6,698,618 | B2 | 3/2004 | Ramsey |
| 6,722,531 | B2 | 4/2004 | Matsuo et al. |
| 6,877,638 | B2 | 4/2005 | Chan et al. |
| 2005/0161470 | A1 | 7/2005 | Johns et al. |

FOREIGN PATENT DOCUMENTS

| | | |
|---|---|---|
| GB | 2368059 | 4/2002 |
| JP | 6092830 A | 4/1994 |

OTHER PUBLICATIONS

Didry et al., 1994, "Activity of thymol, carvacrol, cinnamaldehyde and eugenol on oral bacteria," Pharm. Acta Helv. 69(1):25-28.

Gibboni et al., 2003, Aclar®/Barex® Laminates: Flexible Solutions for Pharma Packaging vol. 3, No. 3.

Innovene Europe Ltd., 2005, Product Data Sheet "Barex Barrier Resins Barrier Properties".

International Search Report and Written Opinion in International Application No. PCT/US07/066949 mailed Sep. 14, 2007.

Teijin Dupont Films Japan Limited, 2006, Bi-axially Oriented PEN Film, Teonex Film Material Safety Data Sheet.

Teonex PEN Film, 2007, Teonex Data Sheet (Typical Value) From website http://www.dupontteijinfilms.com/Teonex/Brochure/3.htm, accessed Apr. 2, 2007.

* cited by examiner

CONTAINER FOR PRODUCTS CONTAINING AROMATIC COMPOUNDS

This application claims the benefit of U.S. Provisional Patent Application Ser. No. 60/793,042 filed Apr. 19, 2006, the contents of which are incorporated herein by reference.

The present invention relates to tube containers having shoulder portions that have a barrier unit that has a low absorption for antibacterial compounds, and in particular for aromatic group containing antibacterial compounds. The barrier unit can be a three dimensional insert, a film attached to the inner surface of the tube shoulder/nozzle portions or an inner layer of a co-injection molded tube shoulder/nozzle.

BACKGROUND OF THE INVENTION

Tube containers are used to hold and to dispense a wide range of products. These include adhesives, lubricants, lotions, medicants, shampoos, hair dressings, and various oral care products. Some of the lotions, medicants and oral care products contain an antibacterial compound. A problem with such products is that the antibacterial compound may be absorbed or otherwise degraded by the tube materials. The result is that the tube structure needs to be modified to reduce or to eliminate the absorption by the tube structure for the antibacterial compound. In many cases, and especially for oral care products, it is desirable also to reduce the absorption of the tube structure for other contained substances such as flavors and fragrances. Some package materials absorb flavor and fragrance components in an inappropriate ratio depending on the flavor and fragrance molecules. Thus the flavor or fragrance is changed. This problem needs to be solved for flavors and fragrances to preserve the taste and olfactory properties of the products.

Traditionally, barrier materials have been used to reduce the loss of flavors or fragrances, and in some instances antibacterial compounds. It is widely believed in the industry that a good barrier to flavors and to fragrances is also a good barrier to antibacterial compounds, and that barrier improvement would be similar for all of these organic compounds.

The barrier layer is normally selected based on the flavor or fragrance barrier properties. As used herein the term shoulder/nozzle refers to the shoulder and nozzle as one part or as two separate parts. The shoulder/nozzle, however, poses most of the problems because the shoulder and nozzle are relatively thick compared to the remainder of a tube. This is needed to maintain the mechanical strength of the tube. Further, in order to have good adhesion of the tube body to the shoulder and for cost considerations, polyolefins are usually used as the material for the shoulder/nozzle. The thicker the polymers the greater the absorption. This thickness leads to an unacceptable level of antibacterial compound adsorption. This problem is thought to be solved for flavors by the use of an insert which is a material that has a very low absorptivity for the flavor components. This insert can be an interference fit into the top part of the tube, a film layer onto the inner surface of the tube or a layer co-injection molded onto the inner surface of the shoulder and nozzle.

Unfortunately, the traditional belief that a good flavor barrier leads to a good barrier for antibacterial compounds is not accurate. Polymers will have different adsorption affinities for flavors and for antibacterial compounds because of the differences in structure and polarity of these compounds. It is an objective of the current invention to provide a barrier for tube shoulders, and preferably also the nozzles, for antibacterial compounds as well as for flavors.

BRIEF DESCRIPTION OF THE INVENTION

Tube containers are comprised of a tube body and a tube shoulder/nozzle. The tube body usually is of a laminate structure and the tube shoulder/nozzle of an alkene polymer containing plastic. These usually are polyethylenes and polypropylenes. The tube body will be crimp sealed at the bottom after filling. At the other end the tube shoulder/nozzle will be injection molded and attached to the tube body or compression molded and directly attached to the tube body. While the degree of absorption of an antibacterial can be readily controlled in the body of the tube by an appropriate multi-layer laminate structure this is not the case with regard to the shoulder/nozzle.

It has been found that the aromatic group containing antibacterial compounds such as triclosan [5-chloro-2-(2,4-dichlorophenoxy)phenol] are absorbed at a low level in injection molded shoulder/nozzle parts of a tube container if a barrier unit of a copolymer of acrylonitrile and methylacrylate, a polyethylene naphthalate polymer or a polytrimethylene naphthalate polymer is used. The barrier unit can be a three dimensional insert, a film layer attached to the inner wall of the shoulder/nozzle or a co-injection molded layer on the shoulder/nozzle. In addition the shoulder/nozzle can be solely of these materials. The copolymer of acrylonitrile and methacrylate can have an acrylonitrile content of about 70% to about 80% and a methacrylate content of about 20% to about 30%. Through the use of such a shoulder/nozzle barrier unit the absorption of triclosan by the shoulder/nozzle can be reduced to less than about 10 $mg/dm^2$, preferably less than 5 $mg/dm^2$, and most preferably less than 1 $mg/dm^2$ for a dentifrice containing about 0.3% triclosan. The absorption can be more than 20 $mg/dm^2$ when a barrier unit made from currently used flavor barrier materials such, as polyethylene terephthalate or polybutylene terephthalate, are used. It can range higher when other polymers with barrier properties are used.

It also has been found that when the barrier unit is a polyethylene naphthalate polymer or a polytrimethylene naphthalate polymer the absorptivity for antibacterial compounds can be considerably reduced if the polymer has been biaxially oriented. Such barrier units will usually be in the form of a film. If films of these polymers are to be used polymers are to be used the biaxially oriented version is preferred.

DETAILED DESCRIPTION OF THE INVENTION

Figure 1:
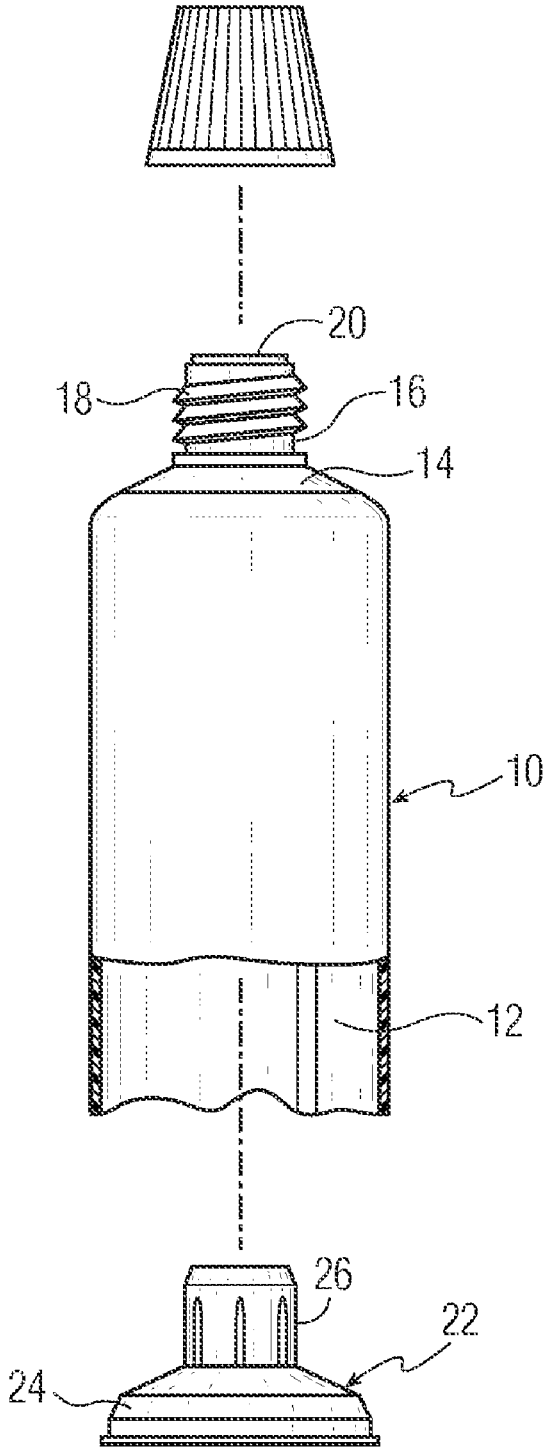
FIG. 1 is an exploded view of the tube, three-dimensional insert, shoulder, nozzle and closure prior to the tube being filled.

FIG. 1 is an exploded view of a tube container 10 that has a barrier unit in the shoulder/nozzle. The tube container 10 has a body portion, a shoulder portion 14 and a nozzle 16. The nozzle will usually have exterior threads 18 for the attachment of a closure 26. The nozzle has an exit opening 20 for the tube container 10. The barrier unit 22 has a section 24 that conforms in shape to the inner wall of the tube shoulder 14 and nozzle 16. This barrier unit will be located between the shoulder/nozzle 14/16 and the substance to be dispensed contained in the tube 12. The barrier unit can be a three dimensional unit having a shape that conforms to the shape of the shoulder/nozzle 14/16 and is an interference fit into the shoulder/nozzle 14/16 as described in FIG. 2, a film unit that is attached to the inner wall of shoulder/nozzle 14/16 as described in FIG. 3, or a barrier unit that is a co-extruded layer on the inner surface of shoulder/nozzle 14/16 as described in FIG. 4.

Figure 2:
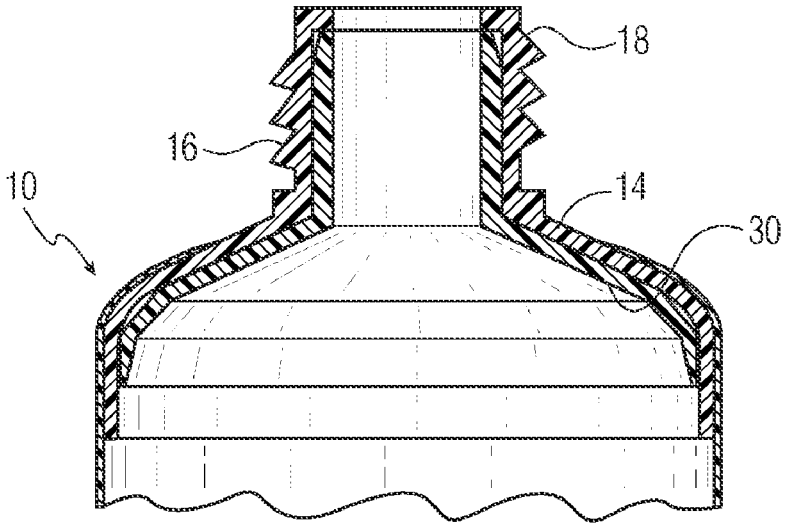
FIG. 2 is a cross-sectional view of the shoulder with the insert of FIG. 1.

FIG. 2 is a cross-section of the tube 10 shoulder/nozzle 14/16 with a barrier unit 30 in place. This barrier unit is of a polymeric construction that has a low absorptivity for antibacterial compounds, and in particular for aromatic group containing antibacterials such as triclosan. The polymer preferably can be any one of a copolymer of acrylonitrile and methacrylate, a polymer of polyethylene naphthalate or a polymer of polytrimethylene naphthalate. If a copolymer of acrylonitrile and methacrylate the acrylonitrile content can be from about 70% to about 80% with the remainder primarily being methacrylate. The barrier unit 30 can be injection molded to produce barrier units that maintain their dimensions and do not have any micro-cracks that would permit the substance to be dispensed from the tube from contacting the shoulder/nozzle 14/16 wall inner surface.

Figure 3:
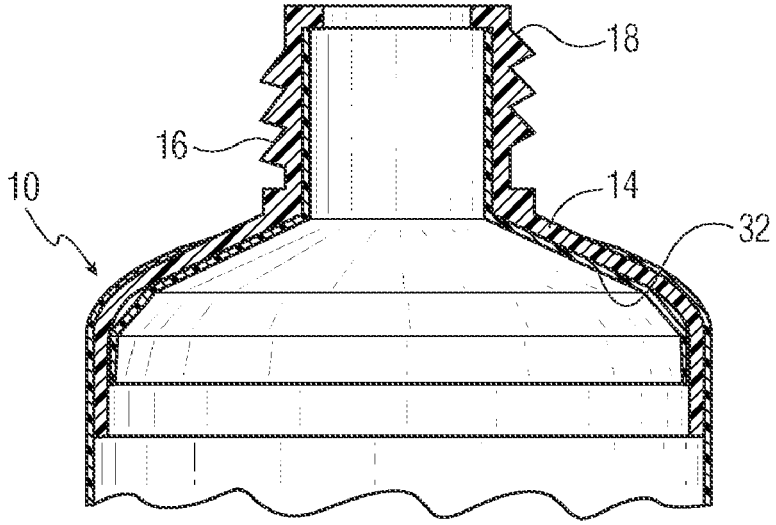
FIG. 3 is a cross-sectional view of the shoulder with an attached barrier film.

FIG. 3 is a cross-section of the tube 10 shoulder/nozzle 14/16 with a barrier unit 32 in place. This barrier unit is of a polymeric film construction that has a low absorptivity for antibacterial compounds, and in particular for aromatic group containing antibacterials such as triclosan. The barrier unit is a laminate film of at least one barrier film and at least one attaching film for attaching the barrier unit to the shoulder/nozzle 14/16. There can be an intermediate film or layer to assist in the laminate bonding of the barrier film to the attaching film. In addition there can be an additional barrier film such as a metal foil in the laminate structure. The barrier polymer preferably can be any one of a copolymer of acrylonitrile and methacrylate, a polymer of polyethylene naphthalate or a polymer of polytrimethylene naphthalate. If a copolymer of acrylonitrile and methacrylate the acrylonitrile content can be from about 70% to about 80% with the remainder primarily being methacrylate. The thickness of the barrier film will be about 1 Mil (25 microns) to about 30 Mil (750 microns). The barrier film 32 can be attached to the inner wall of the shoulder/nozzle 14/16 at the time that the shoulder/nozzle is being formed and attached to the wall of the tube body 12. The barrier film cut to the appropriate shape will be placed on the mandrel of the mold and be attached to the plastic of the shoulder/nozzle 14/16 as the shoulder/nozzle is being formed and attached to the tube body. The barrier polymer will be adjacent to the substance to be dispensed.

Figure 4:
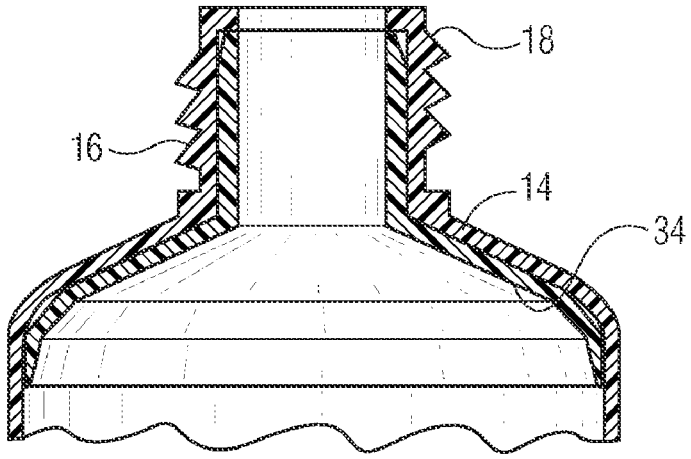
FIG. 4 is a cross-sectional view of the shoulder/nozzle barrier co-injection molded with the shoulder/nozzle.

FIG. 4 is a cross-section of the tube 10 shoulder/nozzle 14/16 with a barrier unit 34 in place. The barrier polymer comprising the barrier unit 34 is co-injection molded with the shoulder/nozzle 14/16 polymer which is an alkene polymer such as a polyethylene or polypropylene. As above the barrier polymer is of a polymeric type that has a low absorptivity for antibacterial compounds, and in particular for aromatic group containing antibacterials such as triclosan. The polymer preferably can be any one of a copolymer of acrylonitrile and methacrylate, a polymer of polyethylene naphthalate or a polymer of polymethylene naphthalate. If a copolymer of acrylonitrile and methacrylate the acrylonitrile content can be from about 70% to about 80% with the remainder primarily being methacrylate. The barrier unit 34 is co-injection molded with the shoulder/nozzle 14/16 with the barrier unit being adjacent to the substance to be dispensed form the tube 10. At the same time as the shoulder/nozzle 14/16 with the barrier unit 34 is being formed it is being attached to the tube body 12.

Figure 5:
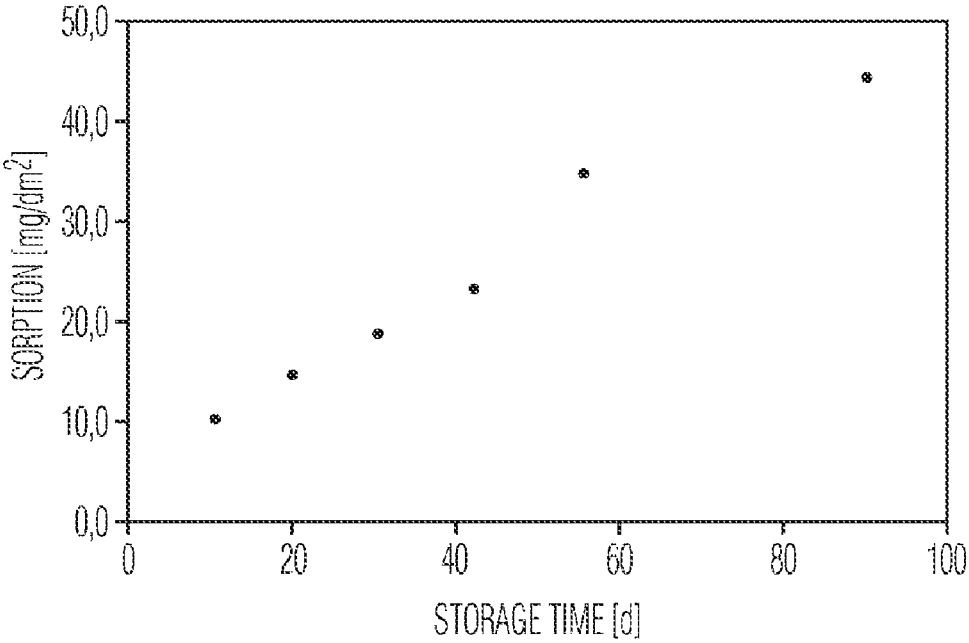
FIG. 5 is a graph of the absorption of triclosan by polyethylene tube shoulders during a 90 day test period.

FIG. 5 is a graph of the absorption of triclosan by a high density polyethylene shoulder/nozzle of a tube. The product is Sorisso (Brazil) dentifrice which has a triclosan content of 0.3%. The test is conducted by having tubes with polyethylene shoulder/nozzles filled with the Sorisso dentifrice, closed and maintained in a temperature chamber at 40° C. for the times set out in the graph of FIG. 5. Tube shoulder/nozzles areas were removed from the tubes and tested for triclosan adsorption. It is seen that about 45 $mg/dm^2$ of triclosan has been absorbed by the polyethylene shoulder in a period of 90 days.

Figure 6:
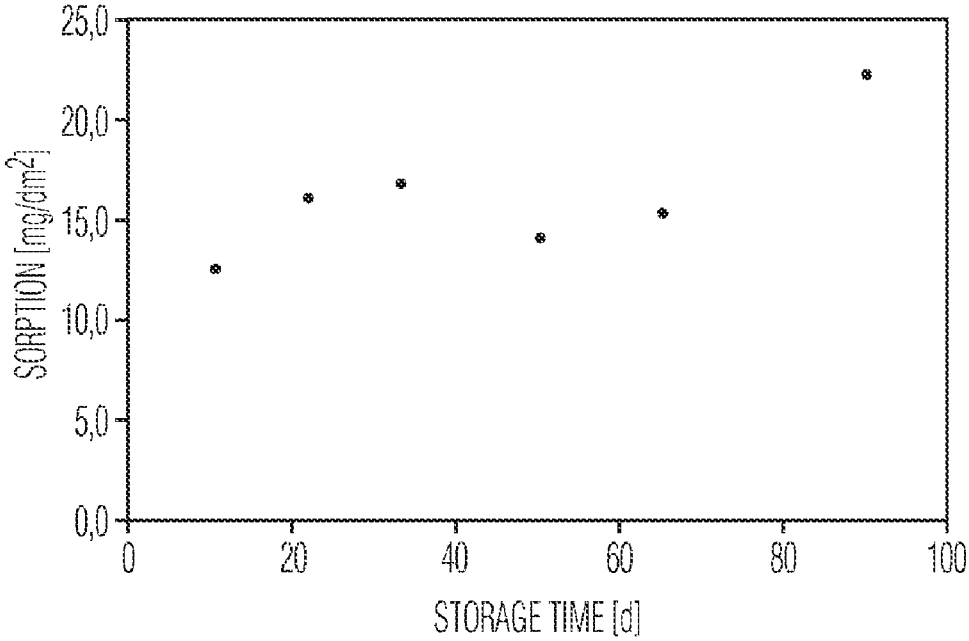
FIG. 6 is a graph of the absorption of triclosan by the shoulder/nozzle of a polyethylene terephthalate shoulder/nozzle of a tube during a 90 day test period.

In FIG. 6 the graph of the absorption of triclosan by polyethylene terephthalate shoulder/nozzles. The test procedure consisted of shoulder/nozzle samples filled with Colgate Total Whitening Plus gel dentifrice with a 0.3% triclosan content and sealed in aluminum foil. The data on the graph shows that after 90 days at 40° C. more than 30 $mg/dm^2$ of triclosan has been absorbed by the polyethylene terephthalate nozzle shoulder.

Figure 7:
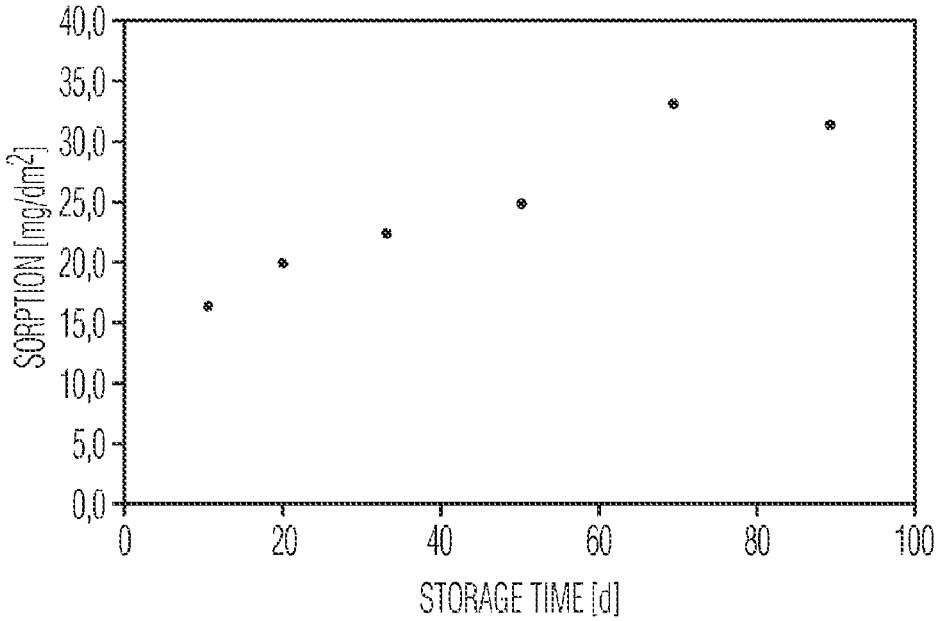
FIG. 7 is a graph of the absorption of triclosan by the shoulder/nozzle of a tube comprised of high density/medium density polyethylene during a 90 day test period.

FIG. 7 is a graph that gives the data for the absorption of triclosan by a shoulder/nozzle comprised of high density/medium density polyethylene. The test procedure consisted of filling tubes having high density/medium density polyethylene shoulder/nozzles with Colgate Total Whitening Plus gel dentifrice containing 0.3%. After 90 days at 40° C. the high density/medium density polyethylene polymer shoulder/nozzle has absorbed about 35 mg/dm$^2$ of triclosan.

Figure 8:
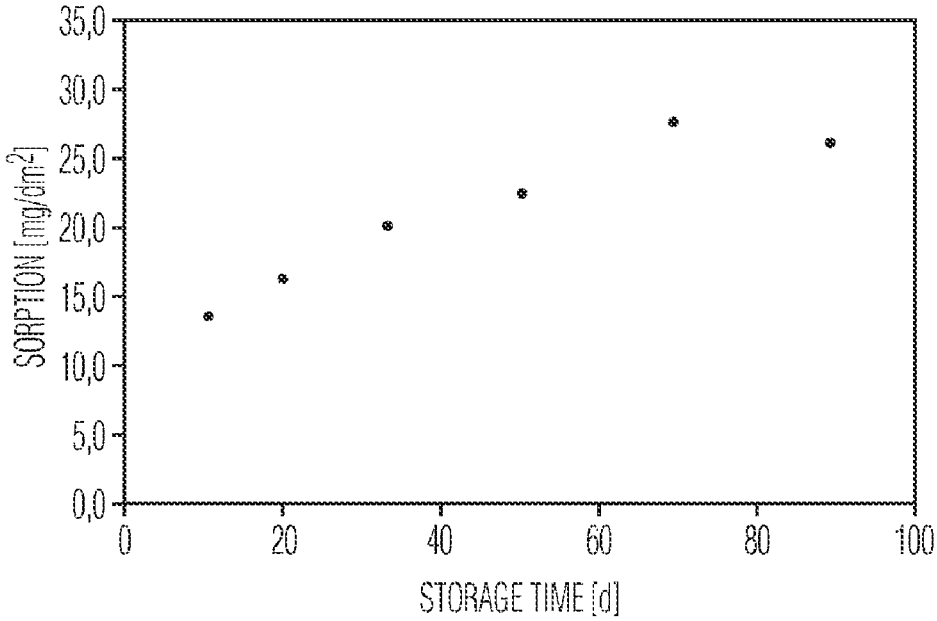
FIG. 8 is a graph of the absorption of triclosan by the shoulder/nozzle of a tube comprised of polybutylene terephthalate during a 90 day test period.

FIG. 8 is a graph that gives the data for the absorption of triclosan by a shoulder/nozzle comprised of polybutylene terephthalate. The test procedure consisted of filling shoulder/nozzles with Colgate Total Whitening Plus gel dentifrice containing 0.3% triclosan and sealing the filled shoulders in aluminum foil. After 90 days at 40° C. the polybutylene terephthalate polymer has absorbed about 30 mg/dm$^2$ of triclosan.

Figure 9:
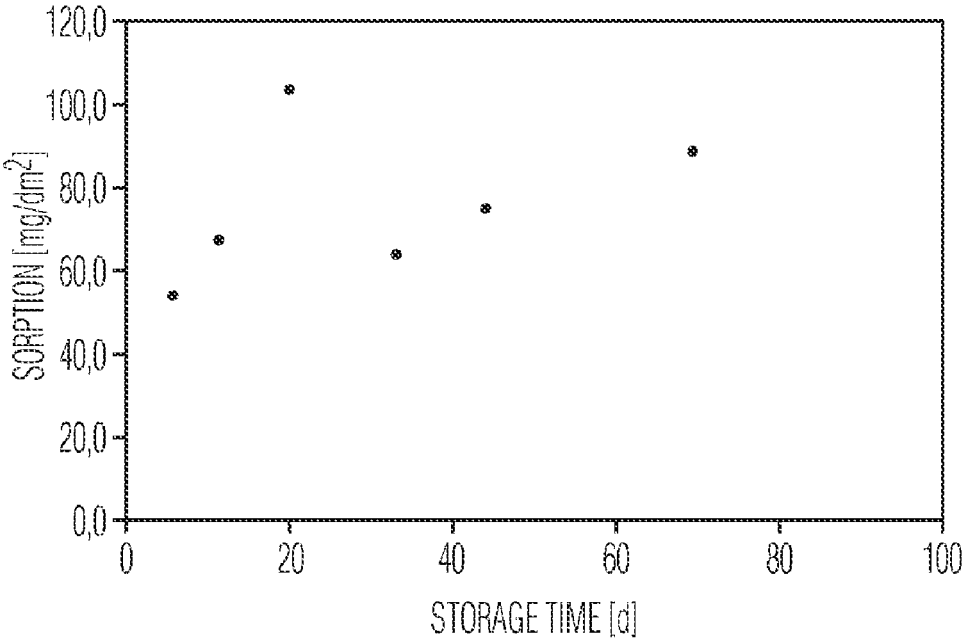
FIG. 9 is a graph of the absorption of triclosan by a silicone insert during a 90 day test period.

FIG. 9 is a graph that gives the data for the absorption of triclosan by a silicone insert. The test procedure consisted of immersing the silicone inserts in a closed jar containing Colgate Total Whitening Plus gel dentifrice, the dentifrice containing 0.3% triclosan. After 90 days at 40° C. the silicone insert has absorbed about 90 mg/dm$^2$ of triclosan.

Figure 10:
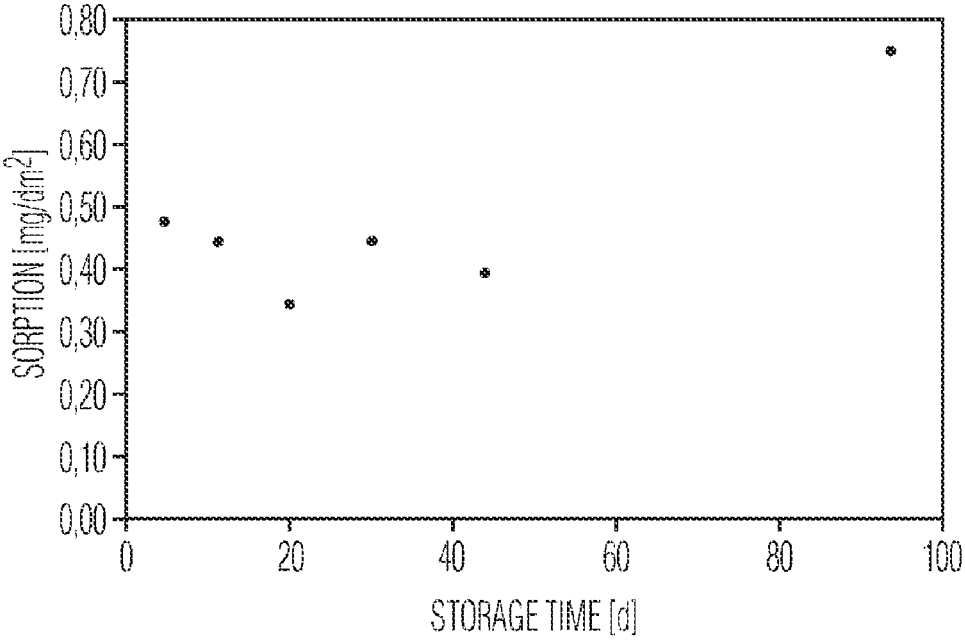
FIG. 10 is a graph of the absorption of triclosan by a film of a copolymer of acrylonitrile/methacrylate during a 90 day test period.

FIG. 10 is a graph that gives the data for the absorption of triclosan by a film barrier unit of acrylonitrile/methacrylate. The test procedure consisted of immersing film samples in a closed jar containing Colgate Total Whitening Plus gel dentifrice, the dentifrice containing 0.3% triclosan. After 90 days at 40° C. the acrylonitrile/methacrylate polymer has absorbed less than 0.8 mg/dm$^2$ of triclosan.

Figure 11:
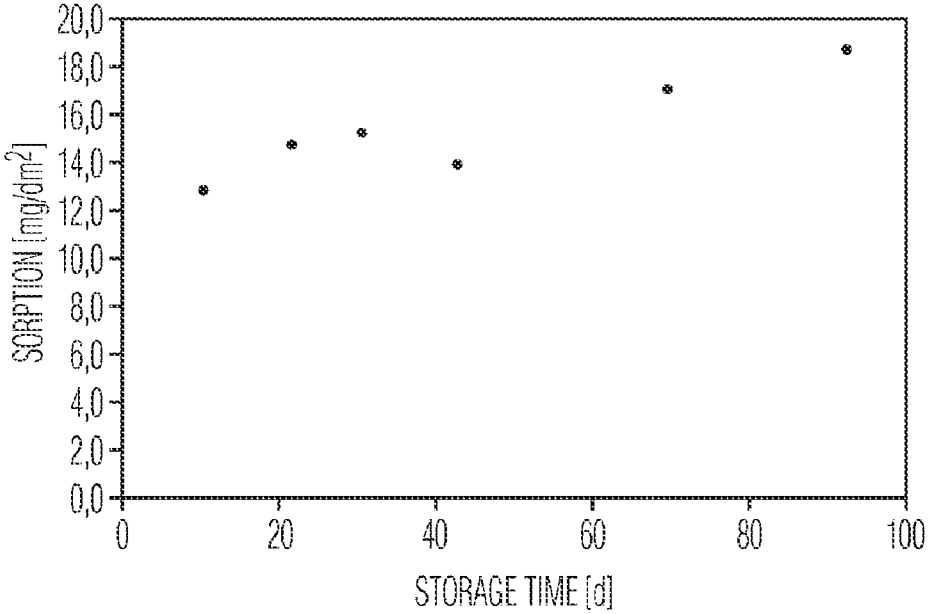
FIG. 11 is a graph of the absorption of triclosan by a nylon film during a 90 day test period.

FIG. 11 is a graph that gives the data for the absorption of triclosan by a nylon. The test procedure consisted of filling Colgate Total Whitening Plus gel dentifrice into a migration cell with a nylon film on one surface. The dentifrice contains 0.3% triclosan. The migration cell was closed, inverted so that the dentifrice contacted to nylon film and placed into an oven kept at 40° C. After 90 days at 40 C the nylon has absorbed about 18 mg/dm$^2$ of triclosan.

Figure 12:
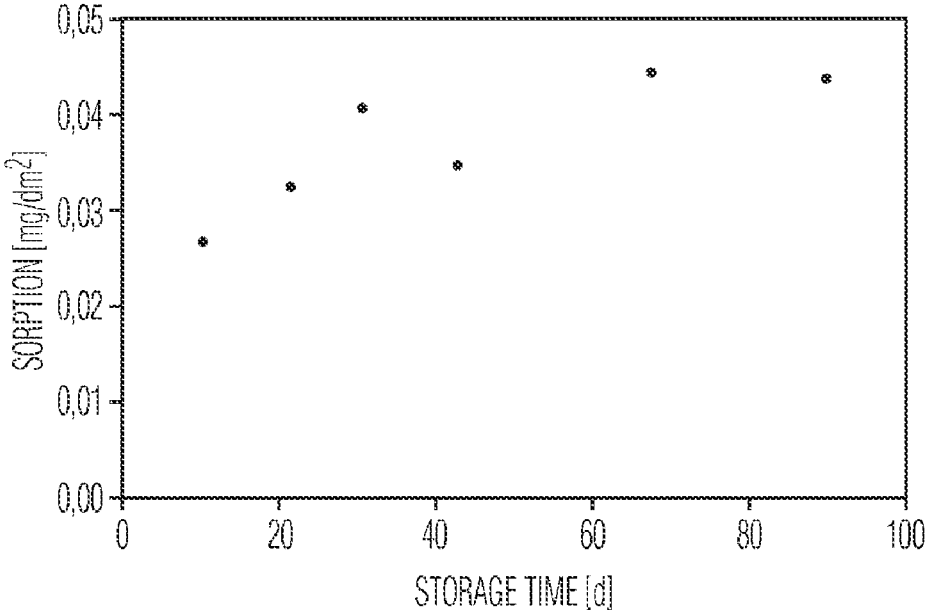
FIG. 12 is a graph of the absorption of triclosan by a biaxially oriented polyethylene naphthalate film during a 90 day test period.

FIG. 12 is a graph that gives the data for the absorption of triclosan by a film of biaxially oriented polyethylene-2,6-naphthalate (DuPont Tejin film, Teonex Q51- 48 gauge). The test procedure consisted of immersing film samples in a closed jar containing Colgate Total Whitening Plus gel dentifrice, the gel dentifrice containing 0.3% triclosan. After 90 days at 40° C. the polyethylene naphthalate polymer has absorbed less than 0.05 mg/dm$^2$ of triclosan.

Figure 13:
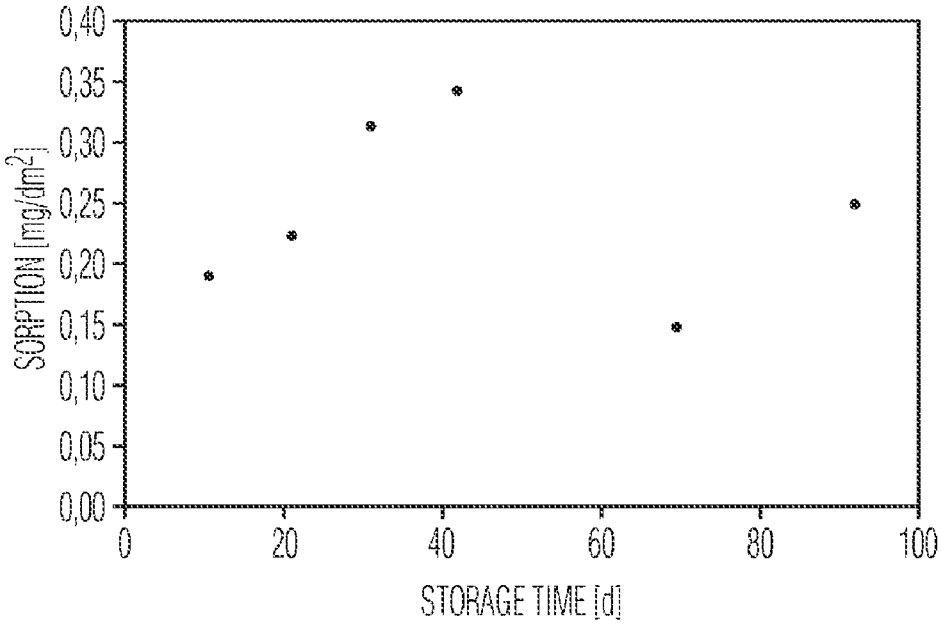
FIG. 13 is a graph of the absorption of triclosan by a tube shoulder/nozzle of a copolymer of acrylonitrile/methacrylate during a 90 day test period.

FIG. 13 is a graph that gives the data for the absorption of triclosan by shoulder/nozzles of acrylonitrile/methacrylate polymer. The test procedure consisted of filling the shoulder/nozzles with Colgate Total Whitening Plus gel dentifrice, the dentifrice containing 0.3% triclosan. The filled shoulder/nozzles that were sealed aluminum foil and placed in an oven at 40° C. After 90 days at 40 C the acrylonitrile/methacrylate polymer has absorbed less than 0.4 mg/dm$^2$ of triclosan.

Figure 14:
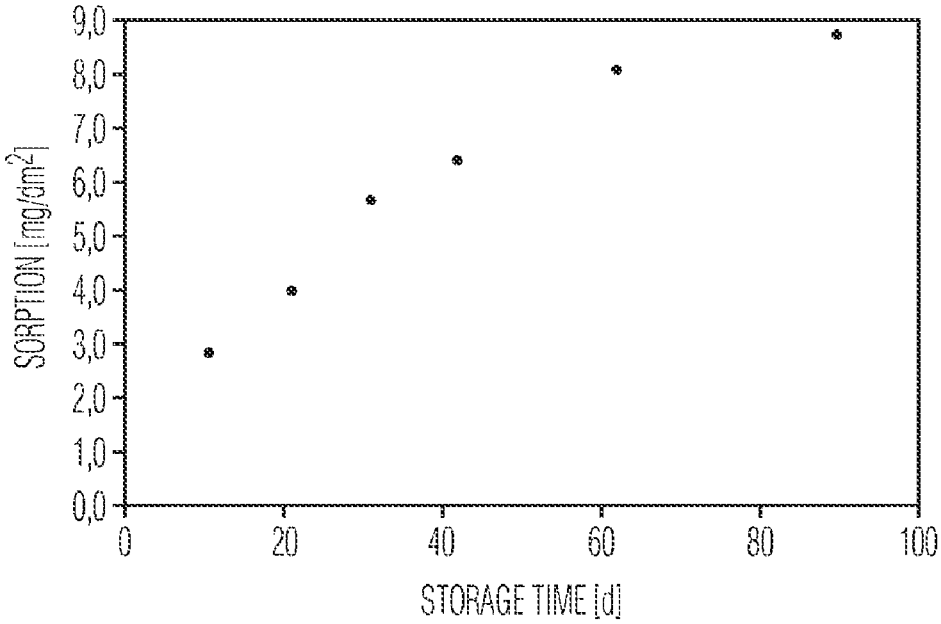
FIG. 14 is a graph of the absorption of triclosan by a tube shoulder/nozzle of a copolymer of polyethylene naphthalate during a 90 day test period.

FIG. 14 is a graph that gives the data for the absorption of triclosan by shoulder/nozzles of amorphous polyethylene naphthalate polymer. The test procedure consisted of filling the shoulder/nozzles with Colgate Total Whitening Plus gel dentifrice, the dentifrice containing 0.3% triclosan. The filled shoulder/nozzles that were sealed aluminum foil and placed in an oven at 40° C. After 90 days at 40° C. the amorphous polyethylene naphthalate polymer has absorbed less than 9 mg/dm$^2$ of triclosan.

Figure 15:
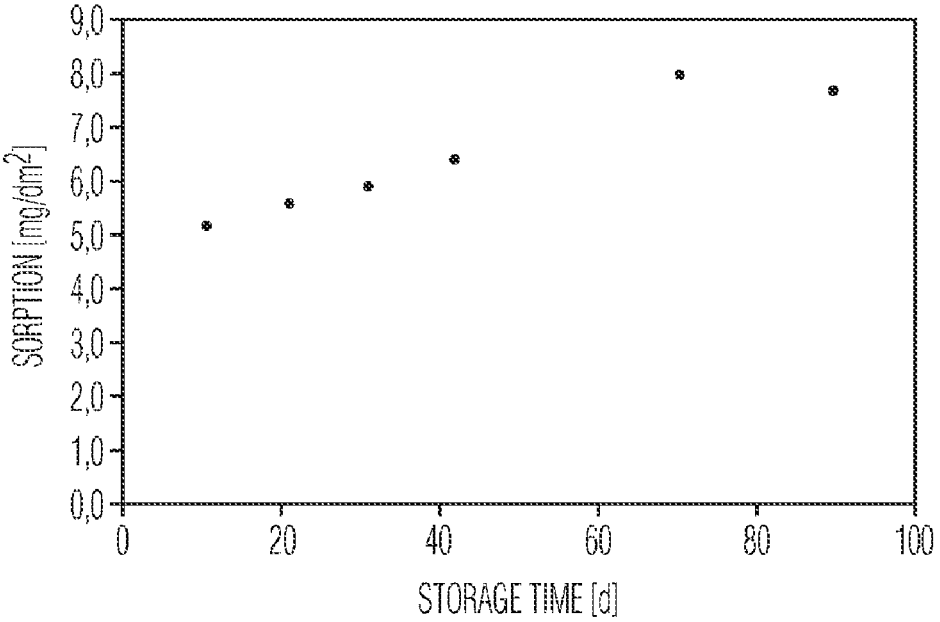
FIG. 15 is a graph of the absorption of triclosan by a tube shoulder/nozzle of a copolymer of polytrimethylene naphthalate during a 90 day test period

FIG. 15 is a graph that gives the data for the absorption of triclosan by shoulder/nozzles of amorphous polytrimethylene naphthalate polymer. The test procedure consisted of filling the shoulder/nozzles with Colgate Total Whitening Plus gel dentifrice, the dentifrice containing 0.3% triclosan. The filled shoulder/nozzles were sealed in aluminum foil and placed in an oven at 40° C. After 90 days at 40° C. the amorphous polytrimethylene naphthalate polymer has absorbed less than 8 mg/dm$^2$ of triclosan.

Figure 16:
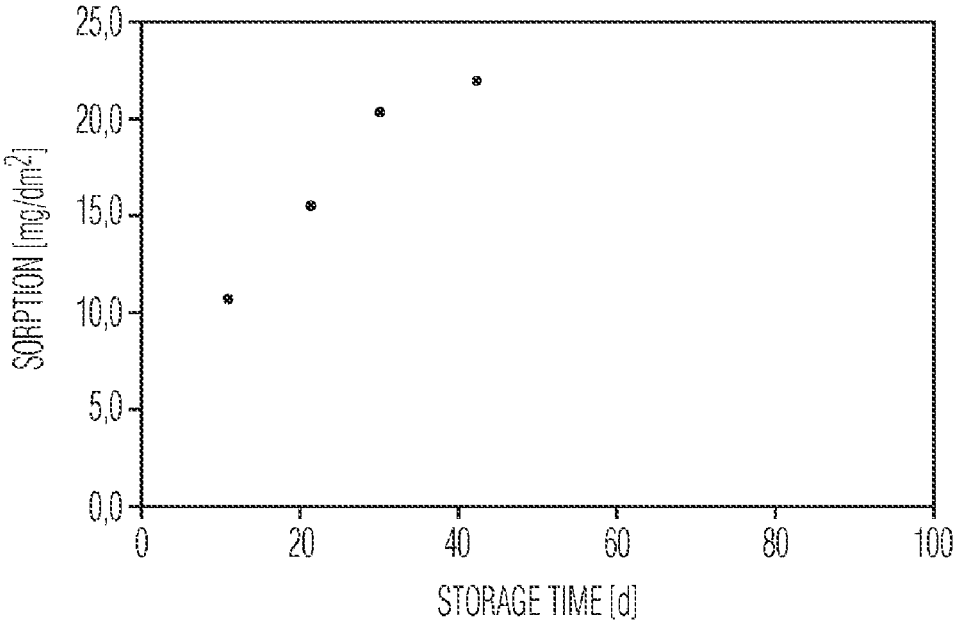
FIG. 16 is a graph of the absorption of triclosan by the polyethylene shoulder/nozzle of a tube during a 40 day test period.

FIG. 16 is a graph of the absorption of triclosan by a high density polyethylene shoulder/nozzle of a tube. The product is Colgate Total Whitening Plus gel dentifrice which has a triclosan content of 0.3%. The test is conducted by having tubes having a diameter of 28 mm containing 114 gms of tooth gel being maintained within a temperature chamber maintained at 40° C. for the times set out in the graph of FIG. 5. Tubes are removed at 10 day intervals and the shoulder/nozzles tested for triclosan adsorption. It is seen that more than 20 mg/dm$^2$ of triclosan has been absorbed by the polyethylene shoulder in a period of 40 days.

Figure 17:
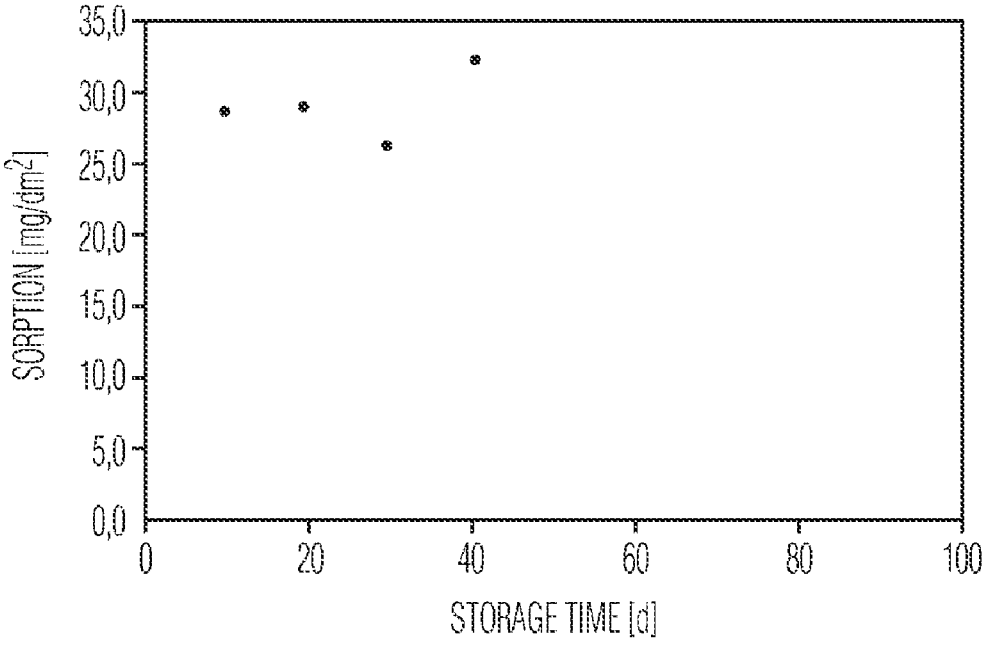
FIG. 17 is a graph of the absorption of triclosan by a three dimensional polyethylene terephthalate barrier unit in the shoulder/nozzle of a tube during a 40 day test period.

FIG. 17 is the graph of the absorption of triclosan by a polyethylene terephthalate three dimensional barrier unit as illustrated in FIG. 2. The same test procedure as that for the above polyethylene shoulders was used. The dentifrice was Colgate Total Whitening Plus gel containing 0.3% triclosan. The data on the graph shows that after 40 days at 40° C. more than 30 mg/dm$^2$ of triclosan has been absorbed by the polyethylene terephthalate barrier unit.

Figure 18:
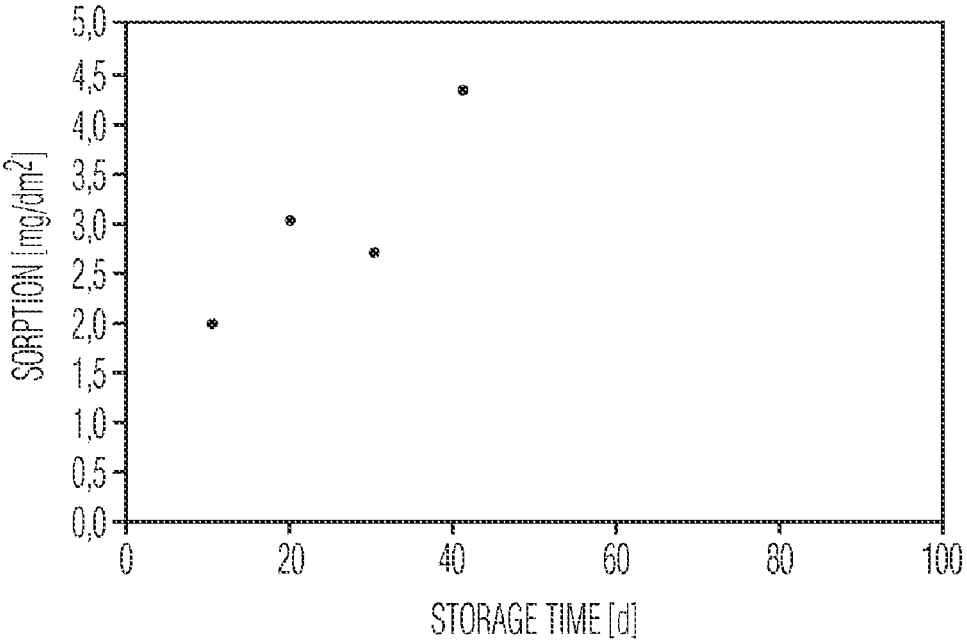
FIG. 18 is a graph of the absorption of triclosan by a three dimensional polyethylene naphthalate barrier unit in the shoulder/nozzle of a tube during a 40 day test period.

FIG. 18 is a graph that gives the data for the absorption of triclosan by a polyethylene naphthalate amorphous barrier unit film as illustrated in FIG. 3. The film could be in both the shoulder and nozzle or only the shoulder. More absorption will-occur in the shoulder due to the larger surface area of the shoulder. The same test procedure as for the polyethylene shoulders was used. The dentifrice was Colgate Total Whitening Plus gel containing 0.3% triclosan. After 40 days at 40° C. the polyethylene naphthalate has absorbed less than 5 mg/dm$^2$. This is less than a polyethylene shoulder and less than a polyethylene terephthalate barrier unit.

Figure 19:
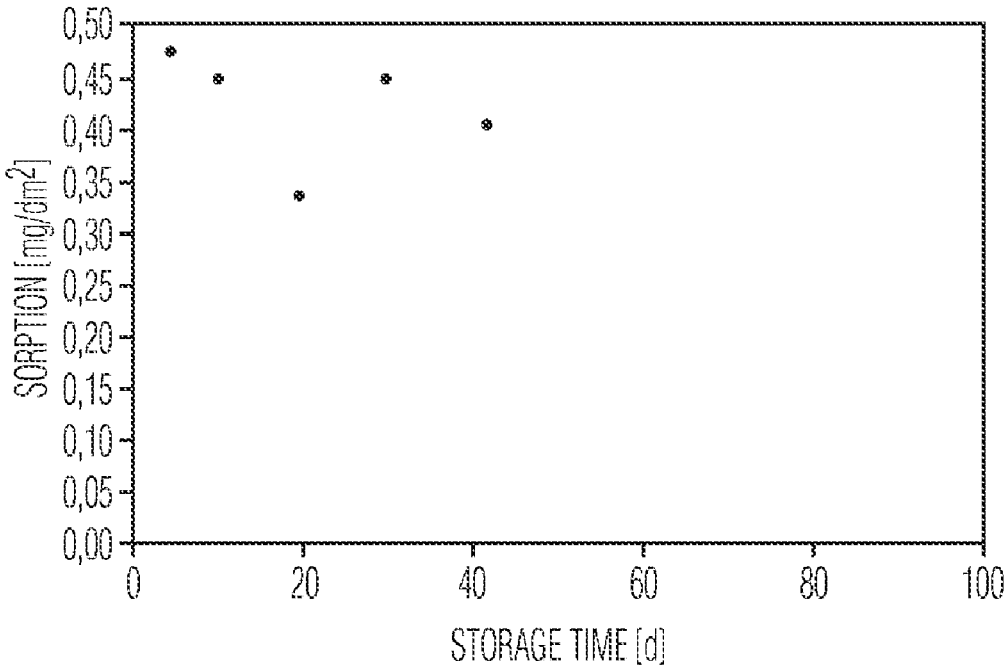
FIG. 19 is a graph of the absorption of triclosan by a three dimensional acrylonitrile/methacrylate copolymer barrier unit in the shoulder/nozzle of a tube during a 40 day test period.

FIG. 19 is a graph that gives the data for the absorption of triclosan by a acrylonitrile/methacrylate copolymer three dimensional barrier unit as described in FIG. 2. The same test procedure as for the polyethylene shoulders was used. The dentifrice was Colgate Total Whitening Plus gel containing 0.3% triclosan. After 40 days at 40° C. the acrylonitrile/methacrylate copolymer also has absorbed less than 0.5 mg/dm$^2$. This, like polyethylene naphthalate, is less than a polyethylene shoulder and less than a polyethylene terephthalate barrier unit.

The test samples were prepared as set in the description of each sample in the description of the particular graph. The dentifrice containing 0.3% triclosan was in intimate contact with the surface of the test sample for the given time period. Depending on the test sample 3.5 gms to more than 50 gms were used. Some of the samples were taken from the oven in 20 day intervals and analyzed. Occluded dentifrice was removed from the sample surface by wiping and the surface rinsed with water to remove all occluded dentifrice. After surface drying defined surface areas were cut from each of the samples and each sample extracted with dichloromethane. Extraction was by immersion in the dichloromethane for 24 hours at 40° C. To ascertain that the extraction was complete the procedure was repeated for each sample. These dichloromethane extractant solutions were analyzed for triclosan content by gas chromatography. The concentrations of triclosan in each extraction were added together to provide a final level of triclosan absorbed by the particular polymer. An HP 6890 gas chromatograph was used for the analyses containing a DB 1 (30 m, 0.32 mm, 0.25 micron) column at 50° C. Hydrogen was used as the carrier gas.

The test results are given in the amount of triclosan absorbed by the milligrams of triclosan that is absorbed by a given area of the sample polymer at 40° C. at 10 day intervals for 90 days. The early work on the samples of FIGS. 16 to 19 was conducted for 40 days with later work extending to 90 days. At 40 days at 40° C., in general, an equilibrium will be reached where the absorption of triclosan and the desorption of triclosan will be in equilibrium. This validates the early work. A temperature of 40° C. is the typical highest temperature that a dentifrice will experience for an extended period of time. The substance from which the triclosan is absorbed is the Colgate Total White gel dentifrice which has a triclosan content of 0.3%. The more valuable data is the comparison data. That is, the comparison of the data from polyethylene naphthalate and polytrimethylene polymers and acryloniyrile/methacrylate copolymers with the date high density polyethylene (HDPE), medium density polyethylene (MDPE), amorphous polyethylene terephthalate, and polybutylene terephthalate. HDPE and MDPE are common shoulder and nozzle material. Polyethylene terephthalate, and polybutylene terephthalate are known barrier materials for flavor oils and related substances. Nylons also are known barrier materials for various substances. Acryloniyrile/methacrylate copolymers have triclosan barrier properties that are about 60 times better than polyethylene terephthalate polymers and about 40 times better triclosan barrier properties than polybutylene terephthalate two well known barrier materials. Amorphous polyethylene naphthalate has barrier properties about 4 times better than polyethylene terephthalate with biaxially oriented polyethylene naphthalate having barrier properties of more than 100 times that of polyethylene trerphthalate.

Based on the foregoing data in order to minimize the adsorption of triclosan by the structure of a tube container there should be used a barrier unit, comprised as a three dimensional, film or co-injection molded layer barrier unit of polytrimethylene naphthalate polymer, polyethylene naphthalate polymer or acrylonitrile/methacrylate copolymer. Barrier units comprised of these materials will limit the loss of triclosan in the formulation by the adsorption of the triclosan by the materials of the shoulder/nozzle of the tube. Further a biaxially oriented polyethylene naphthalate and a biaxially oriented polytrimethylene naphthalate have a significantly lower absorption for triclosan than each of these polymers in a non-biaxially oriented version. These polymers and copolymers have a significantly lower absorption for triclosan than the range of other polymers that have been tested as shown in the graphs.

We claim:

1. A container for a composition comprising at least one antibacterial compound, the container comprising a lower body portion and an upper shoulder portion, the upper shoulder portion having a shoulder wall comprising an alkene polymer, a barrier unit coupled to an inner surface of the shoulder wall, the barrier unit comprised of a polymeric material having an adsorption for the antibacterial compound of less that about 10 mg/dm$^2$ at 40° C. for 90 days.

2. The container of claim 1 wherein the polymeric material has an absorption for the antibacterial compound of less than about 5 mg/dm$^2$ at 40° C. for 90 days.

3. The container of claim 1 wherein the polymeric material has an absorption for the antibacterial compound of less than about 1 mg/dm$^2$ at 40° C. for 90 days.

4. The container of claim 3 wherein the polymeric material is selected from the group consisting of acrylonitrile/methacrylate copolymers, biaxially oriented polyethylene naphthalate polymers, and biaxially oriented polytrimethylene naphthalate polymers.

5. The container of claim 4 wherein the acrylonitrile/methacrylate copolymers contain about 70% to 80% acrylonitrile and about 20% to 30% methacrylate.

6. The container of claim 1 wherein the polymeric material is selected from the group consisting of acrylonitrile/methacrylate copolymers, polyethylene naphthalate polymers, and polytrimethylene naphthalate polymers.

7. The container of claim 6 wherein the acrylonitrile/methacrylate copolymers contain about 70% to 80% acrylonitrile and about 20% to 30% methacrylate.

8. The container of claim 1 wherein said antibacterial compound contains an aromatic group.

9. The container of claim 8 wherein said antibacterial compound is triclosan.

10. The container of claim 9 the polymeric material is selected from the group consisting of acrylonitrile and methacrylate copolymers, polyethylene naphthalate polymers, and polytrimethylene naphthalate polymers.

11. The container of claim 10 wherein the acrylonitrile and methacrylate polymer contains about 70% to 80% acrylonitrile and about 20% to 30% methacrylate.

12. The container of claim 1 wherein the substance is a dentifrice containing about 0.3% antibacterial compound.

13. The container of claim 1 wherein the container is a tube container.

14. The container of claim 2 wherein the container is a tube container.

15. The container of claim 3 wherein the container is a tube container.

16. The container of claim 4 wherein the container is a tube container.

* * * * *

UNITED STATES PATENT AND TRADEMARK OFFICE

CERTIFICATE OF CORRECTION

PATENT NO. : 8,383,215 B2
APPLICATION NO. : 12/297731
DATED : February 26, 2013
INVENTOR(S) : Yu Shi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1164 days.

Signed and Sealed this
Tenth Day of December, 2013

Margaret A. Focarino

Margaret A. Focarino
*Commissioner for Patents of the United States Patent and Trademark Office*